US008438812B2

(12) United States Patent
King et al.

(10) Patent No.: US 8,438,812 B2
(45) Date of Patent: May 14, 2013

(54) SHINGLES AND METHODS OF APPLYING SHINGLES

(75) Inventors: Thomas Morrison King, Carl Junction, MO (US); Stephen Andrew McNally, Joplin, MO (US)

(73) Assignee: TAMKO Roofing Products, Inc., Joplin, MO (US)

( * ) Notice: Subject to any disclaimer, the term of this patent is extended or adjusted under 35 U.S.C. 154(b) by 1656 days.

(21) Appl. No.: 10/308,731

(22) Filed: Dec. 3, 2002

(65) Prior Publication Data

US 2004/0103611 A1 Jun. 3, 2004

(51) Int. Cl.
*E04D 1/12* (2006.01)
*B44F 9/02* (2006.01)

(52) U.S. Cl.
USPC ..... 52/554; 52/557; 52/314

(58) Field of Classification Search ..... 52/557, 52/555, 554, 558, 559, 314; D25/139; 428/143, 428/207
See application file for complete search history.

(56) References Cited

U.S. PATENT DOCUMENTS

| | | | | |
|---|---|---|---|---|
| 1,495,070 A | | 5/1924 | Finely | |
| 1,496,108 A | * | 6/1924 | Wilson et al. | 52/555 |
| 1,629,146 A | * | 5/1927 | Busha | 52/518 |
| 1,862,852 A | * | 6/1932 | Harshberger | 52/555 |
| 1,879,378 A | * | 9/1932 | McWilliams | 52/555 |
| 2,197,972 A | * | 4/1940 | Ernst | 52/557 |
| 2,307,751 A | * | 1/1943 | Abraham | 52/554 |
| 2,427,522 A | * | 9/1947 | Cesery | 52/555 |
| 3,613,328 A | | 10/1971 | Morgan, Jr. et al. | |
| 3,624,975 A | * | 12/1971 | Morgan et al. | 52/105 |
| 3,921,385 A | * | 11/1975 | Harding et al. | 368/69 |
| 4,195,461 A | * | 4/1980 | Thiis-Evensen | 52/557 |
| 4,717,614 A | * | 1/1988 | Bondoc et al. | 428/143 |
| D344,144 S | | 2/1994 | Weaver et al. | D25/139 |
| 5,501,056 A | | 3/1996 | Hannah et al. | 52/748.1 |
| D369,421 S | | 4/1996 | Kiik et al. | D25/139 |
| 5,611,186 A | | 3/1997 | Weaver | 52/557 |
| 5,666,776 A | * | 9/1997 | Weaver et al. | 52/557 |
| 6,014,847 A | * | 1/2000 | Phillips | 52/311.1 |
| 6,038,826 A | * | 3/2000 | Stahl et al. | 52/554 |
| 6,289,648 B1 | | 9/2001 | Freshwater et al. | 52/557 |
| 6,355,132 B1 | | 3/2002 | Becker et al. | 156/260 |
| 6,360,638 B1 | | 3/2002 | White et al. | 83/13 |
| 6,457,290 B1 | * | 10/2002 | Elliott | 52/554 |

(Continued)

FOREIGN PATENT DOCUMENTS

WO WO 01/30676 5/2001

OTHER PUBLICATIONS

"Hearthstead shingles," Certainteed Shingle Applicator's Manual V, Ch. 13, 127-134; publication date unknown (printed from the internet in May 2003).
"Asphalt/composition shingles and the Secretary of the Interior's Standards for Rehabilitation," revised Oct. 23, 2000.

(Continued)

*Primary Examiner* — Joshua J Michener
*Assistant Examiner* — Elizabeth A Plummer
(74) *Attorney, Agent, or Firm* — Fulbright & Jaworski L.L.P.

(57) ABSTRACT

In one embodiment, a shingle includes a first layer having at least one full tab and at least one full cut-out. A second layer is positioned under the first layer. The full tab width to first layer length ratio is greater than 8.5/36. The full cut-out width to first layer length ratio is greater than 8.5/36. A method that includes applying such shingles to a roof.

17 Claims, 12 Drawing Sheets

U.S. PATENT DOCUMENTS

| | | | | |
|---|---|---|---|---|
| 6,804,919 | B2 * | 10/2004 | Railkar | 52/555 |
| 6,813,866 | B2 * | 11/2004 | Naipawer, III | 52/555 |
| 6,933,037 | B2 * | 8/2005 | McCumber et al. | 52/554 |
| 2002/0088324 | A1 | 7/2002 | White et al. | 83/73 |
| 2003/0172611 | A1 * | 9/2003 | Coco et al. | 52/554 |

OTHER PUBLICATIONS

"Residential Manual: Asphalt Roofing," The Asphalt Roofing Manufacturers Association' Design and Application Methods, 47-49, 1997.

* cited by examiner

SHINGLES AND METHODS OF APPLYING SHINGLES

BACKGROUND OF THE INVENTION

1. Field of the Invention

The invention relates to shingles and methods of applying shingles. More specifically, the invention relates to shingles configured to help reduce or nearly eliminate objectionable patterns.

2. Description of Related Art

Laminated shingles include at least two layers: a top layer that includes one or more tabs and one or more cut-outs, and a backing strip, or layer, positioned (e.g., disposed) under and often attached (e.g., by gluing) to the top layer. The current state of the art is to use top layers that have tabs that are less than seven inches in width. When these shingles are applied to a roof, the tab or tabs (and partial tab or partial tabs) from the top layers of the shingles can form objectionable, repeating patterns. Examples of these patterns include "striping" (e.g., "tiger striping" or "zebra striping") and "zippering." The term "vibration effects" has also been used to describe the impression these patterns give to the viewer.

Zippers may be straight or have one or more bends. An example of zippering is shown in FIG. 1. Some of the tabs and partial tabs that form the zippers in FIG. 1 are outlined. Zippering is usually magnified when the thickness of the tabs increases, or when the tabs cast shadows.

Stripes may be straight or curved. An example of striping is shown in FIG. 2. Striping is usually magnified when the thickness of the tabs increases, or when the tabs cast shadows.

Many attempts have been made to reduce objectionable patterning. One attempt involved the use of colored striations on shingle layers. See U.S. Pat. No. 5,611,186. Another attempt involved making shingles with random tab patterns. See U.S. Pat. No. 6,220,329.

SUMMARY OF THE INVENTION

The present invention helps reduce or nearly eliminate objectionable patterning, such as striping and zippering. One embodiment is a standard U.S. shingle that includes a first layer having at least one full tab, at least one full cut-out, a full tab width to first layer length ratio greater than 8.5/36, a full cut-out width to first layer length ratio greater than 8.5/36, and a second layer positioned under the first layer. Another embodiment is a method that includes applying such shingles to a roof.

BRIEF DESCRIPTION OF THE DRAWINGS

The following drawings demonstrate aspects of some of the present shingles. They illustrate by way of example and not limitation. Like reference numbers refer to similar elements.

DESCRIPTION OF ILLUSTRATIVE EMBODIMENTS

In this document (including the claims), the terms "comprise" (and any form of comprise, such as "comprises" and "comprising"), "have" (and any form of have, such as "has" and "having"), and "include" (and any form of include, such as "includes" and "including") are open-ended linking verbs. Thus, a shingle "comprising" a first layer and a second layer positioned under the first layer is a shingle that possesses a first layer and an underlying second layer, but is not limited to possessing only two layers. Likewise, a first layer "including" a full tab, a full cut-out, a full tab width to first layer length ratio greater than 8.5/36, and a full cut-out width to first layer length ratio greater than 8.5/36 possesses these four features, but is not excluded from possessing additional features such as additional full tabs, additional full cut-outs, or additional partial tabs or cut-outs.

The terms "a" and "an" mean one or more than one. The term "another" means at least a second or more.

Those of skill in the art will appreciate that in the detailed description below, certain well known components and assembly techniques have been omitted so that the present shingles and methods are not obscured in unnecessary detail. The dimensions provided in English units may be translated to the corresponding metric unit by rounding to the nearest millimeter.

Figure 1:
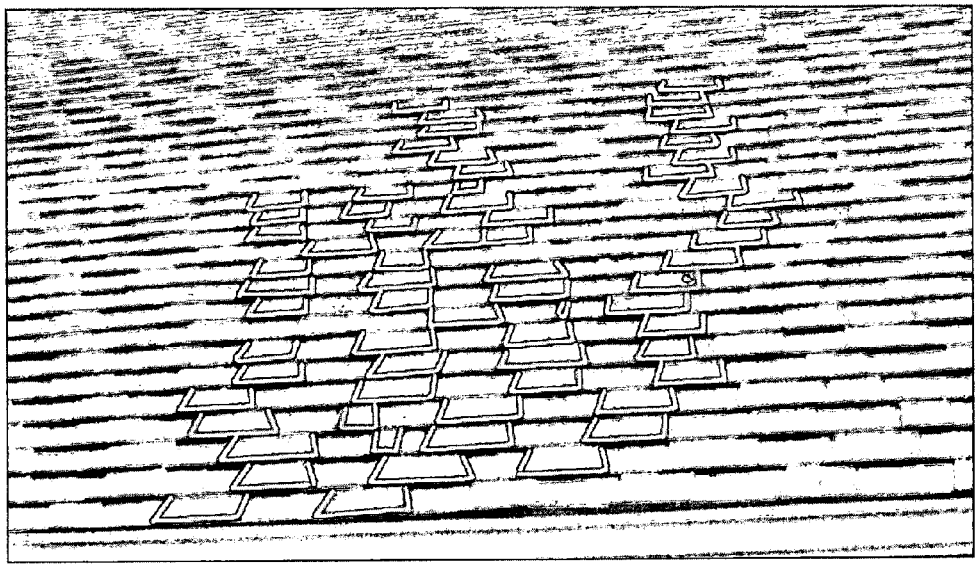
FIG. 1 (PRIOR ART)
FIG. 1 shows an example of zippering.
Figure 2:
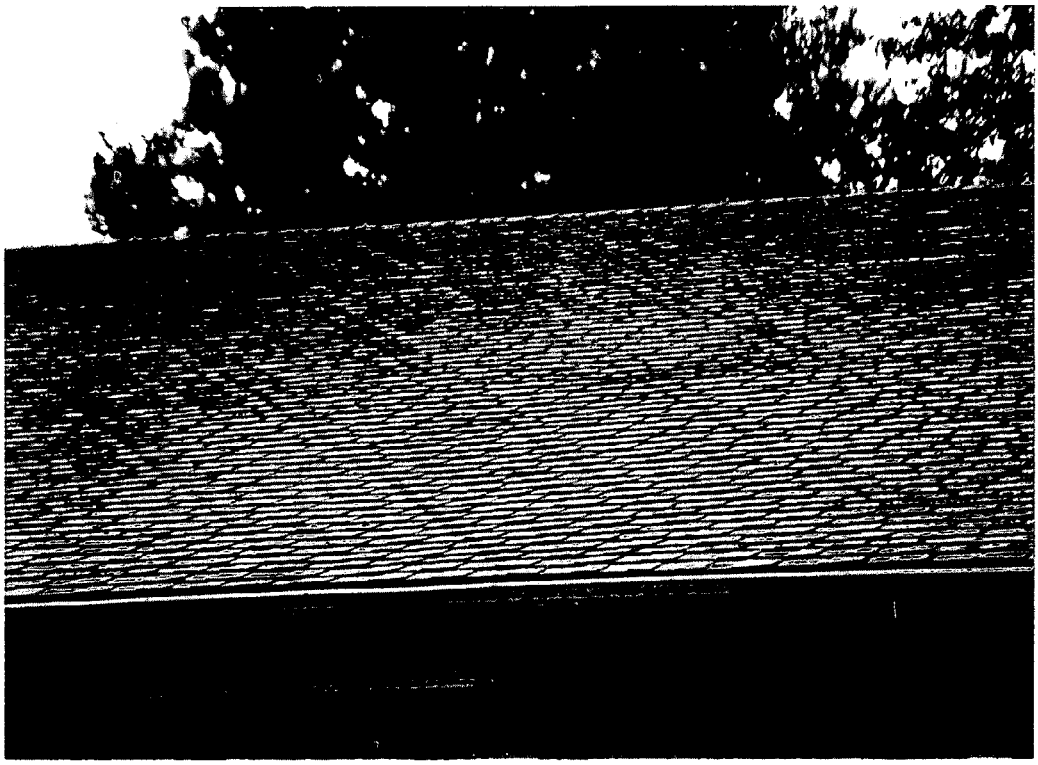
FIG. 2 (PRIOR ART)
FIG. 2 shows an example of striping.
Figure 3:
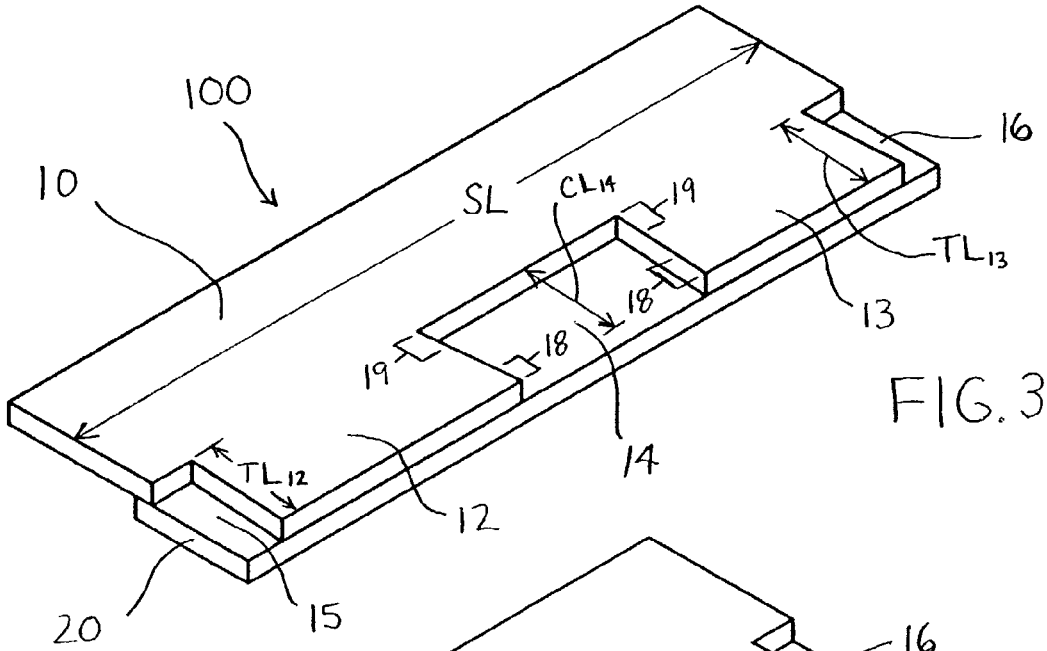
FIG. 3 is a perspective view of the one of the present shingles.

One of the present shingles is shown in FIG. 3. Shingle 100 includes first layer 10 and second layer 20 positioned under first layer 10. Second layer 20 may be attached to first layer 10 in any conventional manner, such as by gluing. First layer 10 includes full tabs 12 and 13, and full cut-out 14. Full tab 12 has tab length $TL_{12}$, full tab 13 has tab length $TL_{13}$, and full cut-out 14 has cut-out length $CL_{14}$. First layer 10 also includes partial cut-outs 15 and 16.

Full tabs 12 and 13 and full cut-out 14 each have a width that is greater than 8.5/36 times the length SL of first layer 10. This is true all along the length of each full tab and full cut-out of first layer 10. Thus, if first layer 10 is cut to the standard U.S. length of 36 inches, full tabs 12 and 13 and full cut-out 14 will have widths that are greater than 8.5 inches.

Using a ratio greater than 8.5/36 for full tab or full cut-out width to shingle (or shingle layer) length has been found to help reduce objectionable patterns. One reason is that, compared to conventional shingles, there are less full tabs and full cut-outs in a given field of vision. Increasing the full tab width to shingle layer length and full cut-out width to shingle layer length ratios even greater than 8.5/36 has been found to reduce objectionable patterns even further. Thus, other suitable thresholds for these ratios include greater than 9/36, 9.5/36, 10/36, 10.5/36, 11/36, 11.5/36, 12/36, 12.5/36, 13/36, 13.5/36, 14/36, 14.5/36, and 15/36.

Full tabs 12 and 13 each have a butt portion 18 and a top portion 19. As shown in FIG. 3, in one version of shingle 100, butt portions 18 are wider than top portions 19. In another version, top portions 19 are wider than butt portions 18. The full tabs of the present shingles may have any number of additional different shapes, provided the minimum width of the full tab complies with the 8.5/36 ratio limit.

Figure 4:
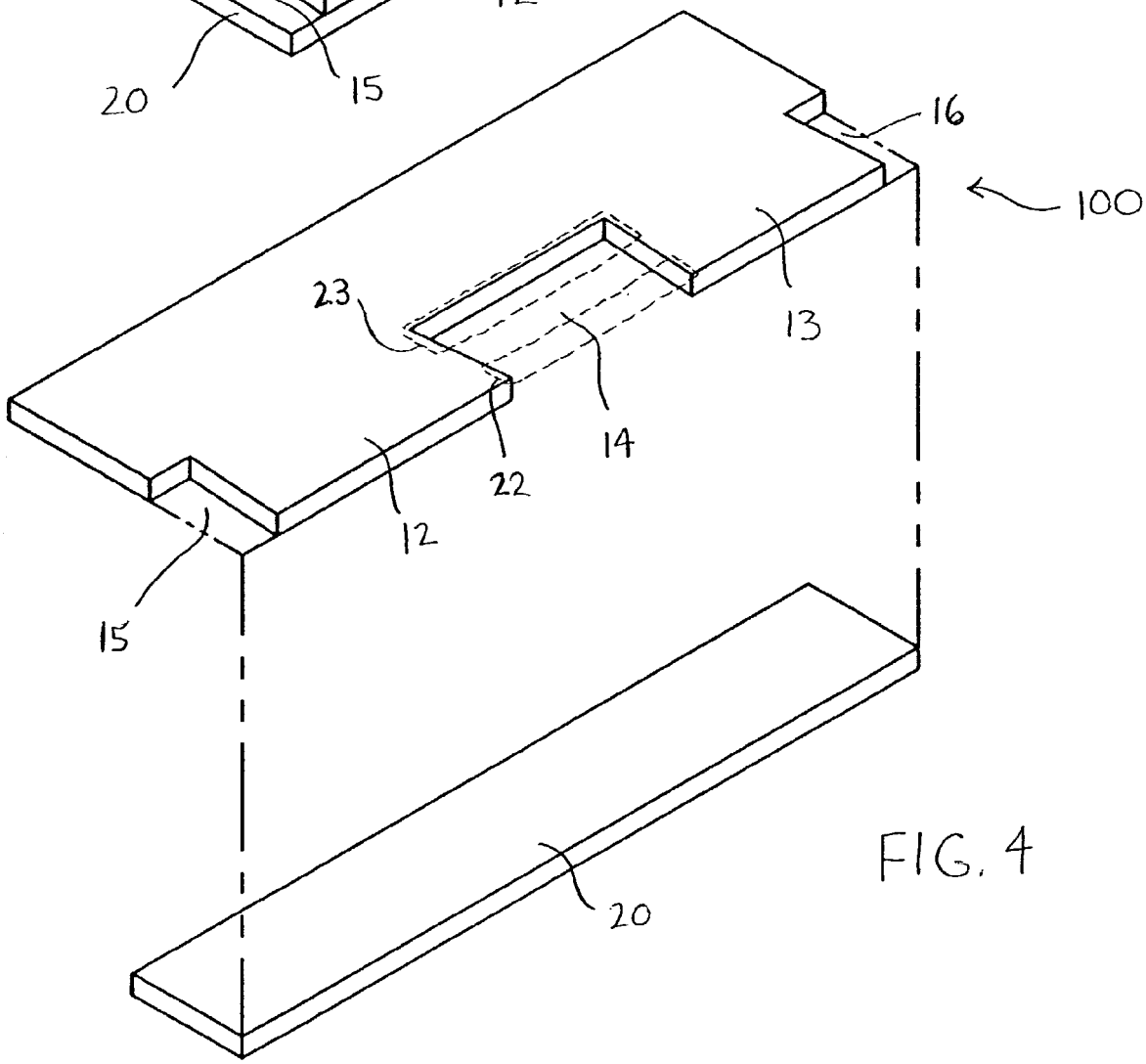
FIG. 4 is an exploded view of the shingle in FIG. 3.

FIG. 4 is an exploded view of the embodiment of shingle 100 shown in FIG. 3. As shown, full cut-out 14 has a butt portion generally outlined by element 22, and a top portion generally outlined by element 23. As shown in FIG. 4, in one version of shingle 100, butt portion 22 of full cut-out 14 is wider than top portion 23 of full cut-out 14. In another version, top portion 23 is wider than butt portions 22. Like the full tabs, the full cut-outs of the present shingles may have a number of additional different shapes, including rectangular and square.

Figure 5:
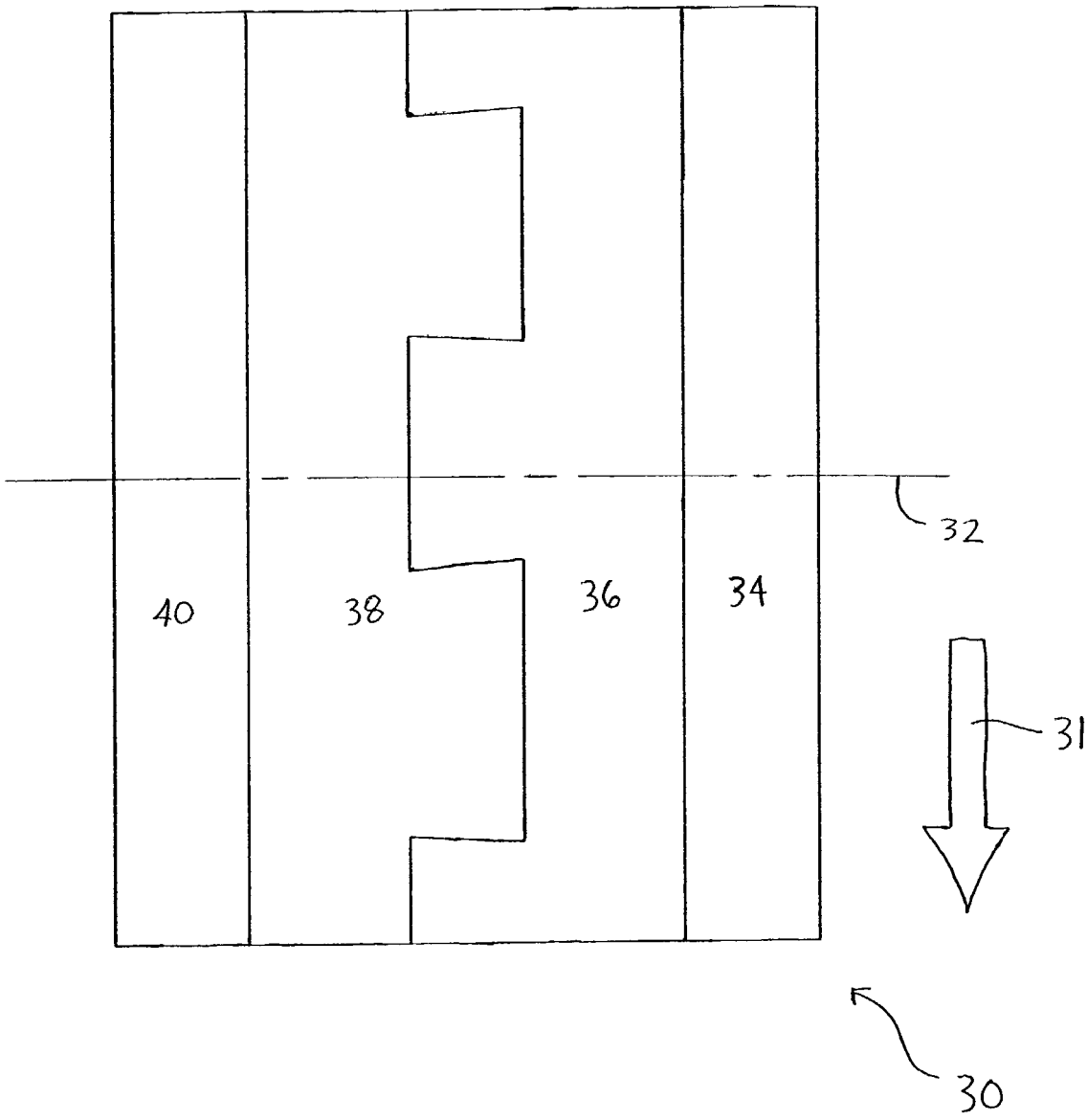
FIG. 5 shows a knife pattern that may be used to create the present shingles.

FIG. 5 shows the knife pattern 30 of a cutting cylinder, or wheel, that may be used in making the present shingles. The wheel to which knife pattern 30 may be applied rotates about axis 32. Arrow 31 shows the direction of sheet flow. The blades between elements 34 and 36 as well as between elements 38 and 40 cut second layers of the present shingles. The blades between elements 36 and 38 cut first layers of the present shingles. The use of a cutting wheel in creating the layers of laminated shingles is well known in the art. Although not shown in FIG. 5, bumpers may be placed in appropriate places as is well known in the art to facilitate clean cuts. There are no blades on the outer edges of the wheel in FIG. 5 (i.e., the sides of the wheel) or at the top and bottom of the pattern. The cutting of the shingle layers to length is done using a separate cutting wheel.

Figure 6:
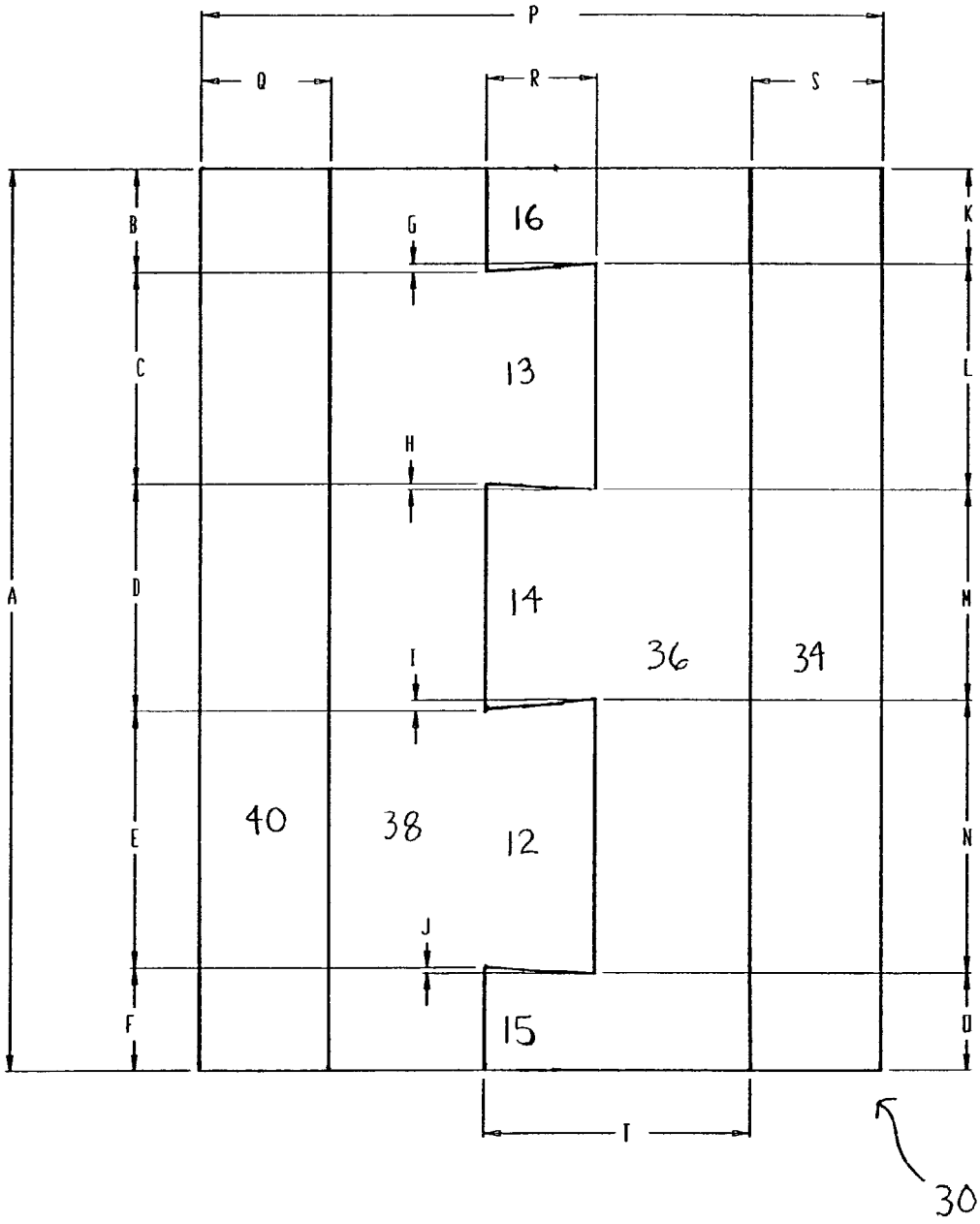
FIG. 6 provides dimensional references to the knife pattern shown in FIG. 5.

FIG. 6 gives the dimensions of the widths and lengths of the shingle layers that can be cut using knife pattern 30. FIG. 6 also gives the dimensions of the full tabs, full cut-outs, partial tabs, and partial cut-outs of the first layers that can be cut using knife pattern 30. These dimensions may be used for full tabs 12 and 13, full cut-out 14, and partial cut-outs 15 and 16. The full cut-out(s) and tab(s) and the partial cut-out(s) and tab(s) of one first layer cut using knife pattern 30 will be the full tab(s) and cut-out(s) and the partial tab(s) and cut-out(s), respectively, of the adjacent first layer cut using knife pattern 30. Thus, full cut-out 14 and partial cut-outs 15 and 16 of the first ply that will be cut using the knives on both sides of element 38 will be the full tab and partial tabs, respectively, of the first layer cut with the knives on both sides of element 36.

Table 1 gives suitable dimensions of standard 36-inch shingles cut using knife pattern 30, and of metric shingles (which are about 13¼ inches by 39⅜ inches) cut using knife pattern 30:

| Dimension element from knife pattern 30 | Dimension (inches) for 36-inch long shingle | Dimension (inches) for "metric" shingle |
|---|---|---|
| A | 41⅛ | 46 |
| B | 4 11/16 | 5⅜ |
| C | 9⅝ | 11½ |
| D | 10⅜ | 13¾ |
| E | 11¾ | 10¼ |
| F | 4 11/16 | 5⅛ |
| G | ⅜ | ⅜ |
| H | ¼ | ¼ |

-continued

| Dimension element from knife pattern 30 | Dimension (inches) for 36-inch long shingle | Dimension (inches) for "metric" shingle |
|---|---|---|
| I | ½ | ½ |
| J | ¼ | ¼ |
| K | 4 5/16 | 5 |
| L | 10¼ | 12⅛ |
| M | 9⅝ | 13 |
| N | 12½ | 11 |
| O | 4 7/16 | 4⅞ |
| P | 30¾ | 33⅞ |
| Q | 5⅞ | 6½ |
| R | 5 | 5⅝ |
| S | 5⅞ | 6½ |
| T | 12 | 13¼ |

The exemplary dimensions from Table 1 may be applied to the full tabs and cut-out and the partial cut-outs of a 36-inch version of shingle 100. As a result, full tab 12 is 11¾ inches wide at its most narrow point. At its widest point on the same shingle, full tab 12 is 12½ inches wide. Accordingly, first layer 10 has a full tab width to first layer length SL ratio greater than 8.5/36 (i.e., the ratio is 11.75/36).

Full tab 13 is 9⅝ inches wide at its most narrow point, and 10¼ inches wide at its widest point, on the same shingle. Thus, first layer 10 again has a full tab width to first layer length SL ratio greater than 8.5/36 (i.e., the ratio is 9.625/36).

Full cut-out 14 is 9⅝ inches wide at its most narrow point, and 10⅜ inches wide at is widest point, on the same shingle. Thus, first layer 10 has a full cut-out width to first layer length SL ratio greater than 8.5/36 (i.e., the ratio is 9.625/36).

Partial cut-outs 16 and 15 will combine to make a full cut-out (and a corresponding full tab on the opposing first layer) on the continuous sheet passing beneath knife pattern 30. On one 36-inch version of shingle 100, such a full cut-out will be 9⅞ inches wide at its most narrow point (along its butt portion) and 10½ inches wide at its widest point (along its top portion). By contrast, the corresponding full tab will have the same dimensions, but a wider butt portion than top portion.

Although full tabs 12 and 13 and full cut-out 14 have different widths in the embodiment shown in FIG. 6, another embodiment of knife pattern 30 may be configured to cut full tabs and cut-outs with the same widths. As another alternative, knife pattern 30 may be configured to cut full tabs that have the same width, and full cut-outs that have the same width, but those two widths may be different.

Dimension A of knife pattern 30, which is also the circumference of the cutting wheel, may be chosen so that it has no common denominator with the length of the shingle it will be cutting. This is accomplished by choosing the circumference and the shingle length such that only the number one can be divided evenly into both. Further, dimension A, which is the length of the shingle pattern before it repeats, may also be chosen to be much larger than the shingle length (e.g., 100, 200, or 300 times larger) in addition to not having a common denominator with the shingle length. Taking these steps will reduce the frequency with which, shingles having an identical pattern are cut. This, in turn, will help reduce or nearly eliminate objectionable patterning. For example, a suitable dimension A for the 36-inch shingle is 41⅛ inches, as stated in Table 1. Another suitable dimension for shingle A is 301⅛ inches. For either of these pattern length/shingle length combinations, the tab and cut-out pattern cut by knife pattern 30 will not repeat for a large number of shingles. More generally, the circumference of the cutting wheel to which knife pattern 30 is applied may be given a diameter that is different from the length of the shingles it cuts.

Creating a color contrast or contrasts between the tabs of the present shingles is another way to help reduce or nearly eliminate objectionable patterning. Creating a color contrast or contrasts between the tabs and exposed portions of the second layer of a given shingle also helps to reduce or nearly eliminate objectionable patterning. Such contrasts may be accomplished using colored granules and known manufacturing techniques. At least one such technique is disclosed in U.S. Patent Application Publication No. US 2001/0049002, which is incorporated by reference.

Although neither of these steps (i.e., the reduction in repeat shingle patterns and color contrast steps) is necessary, both may be used with the width to length ratio limits described above. Alternatively, only one of these two steps may be used with the width to length ratio limits described above.

Figure 7A:
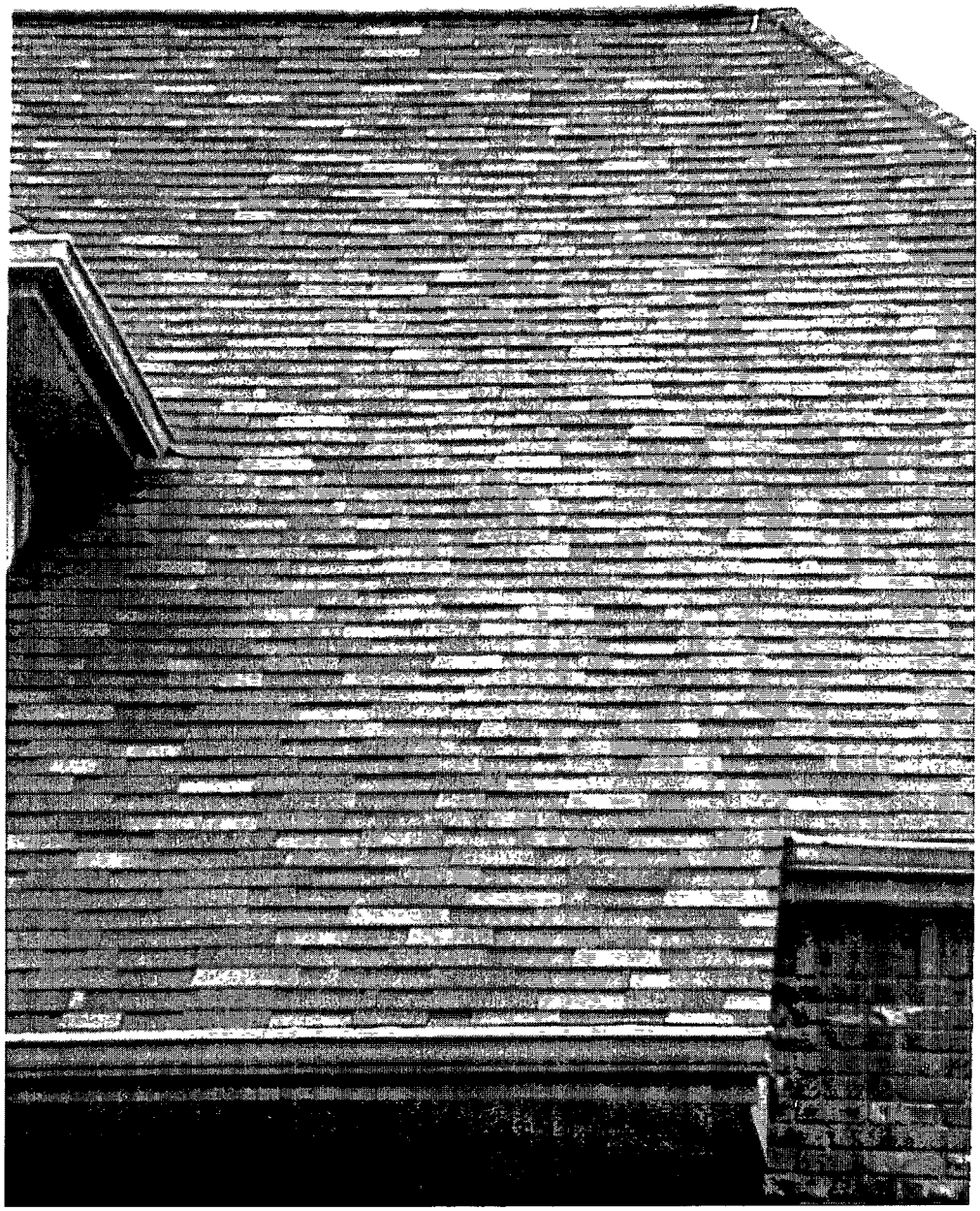
FIGS. 7A and 7B show sections of a roof to which one embodiment of the present shingles was applied.
Figure 7B:
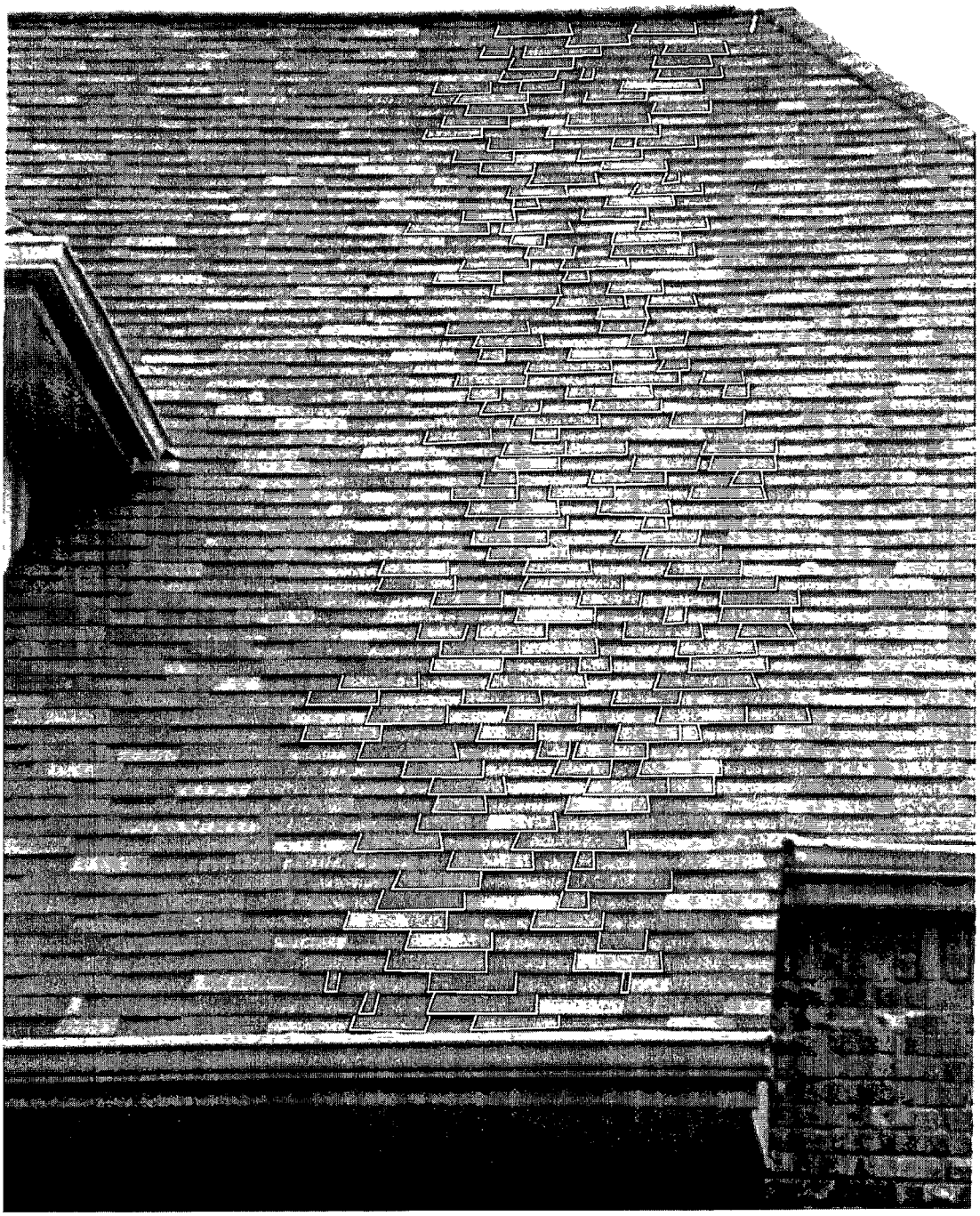

FIGS. 7A and 7B shows examples of the same section of roof to which a standard U.S. version of the present shingles has been applied. In FIG. 7B, some of the edges of some of the tabs and partial tabs of the shingles have been outlined to show the lack of objectionable patterns. The shingles in the roof section depicted in FIGS. 7A and 7B were cut by the knife pattern for 36-inch shingles provided in Table 1.

The application method used for the roof shown in FIGS. 7A and 7B involved applying a first course of shingles, then cutting off 7 inches from a full shingle, and starting a second course of shingles with the resulting 29-inch shingle. A full shingle was cut to 22 inches and used to start the third course. The 14-inch section cut from the third full shingle was used to start the fourth course, and the fifth course was started using the 7-inch section cut from the second full shingle. The sixth through tenth courses were applied in the same manner as the first through fifth courses, and so on. The courses overlapped so that approximately 5 inches of tab and cut-out length were left exposed between courses.

Figure 8:
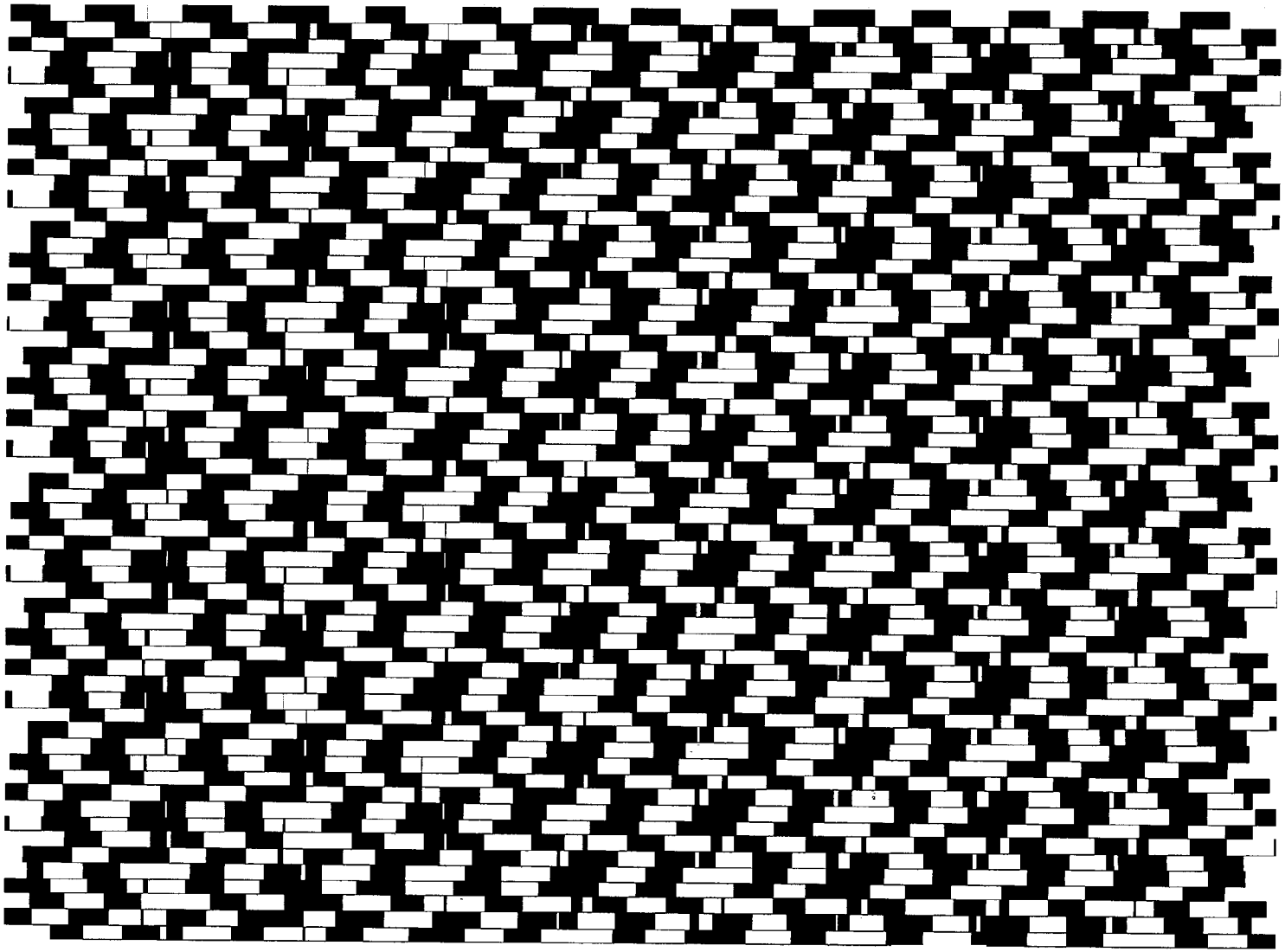
FIG. 8 shows the result of a simulation of applying one embodiment of the present shingles to a 25-foot by 30-foot section of roof using a "rack" method of application.

The present shingles may be applied to a roof to help reduce or nearly eliminate objectionable patterns using any conventional method of application. FIG. 8 is a simulation showing the results of applying the present shingles to a 25-foot deep by 30-foot wide section of roof using a "rack" method of application.

The rack method of application generally involves applying a number of shingles in a course, and then applying an equal number of overlapping shingles in another course. The overlapping shingles are offset from the shingles in the first course by a certain number of inches, such as 6. This process is repeated all the way up the roof. Generally, only one or two shingles are applied in each course. This method of shingle application is generally considered most likely to generate objectionable patterning.

The rack method used to generate the simulation shown in FIG. 8 involved shingles that were 36 inches wide and cut by the knife pattern for 36-inch shingles provided in Table 1. The rack method involved applying one such shingle in one course, and offsetting each overlapping one-shingle course by 6 inches. This 1-shingle, 6-inch overlap rack method was continued across a 25-foot deep by 30-foot wide section of roof to generate the simulation shown in FIG. 8. In FIG. 8, and in FIGS. 9-12, the tabs and partial tabs are shown in black.

Figure 9:
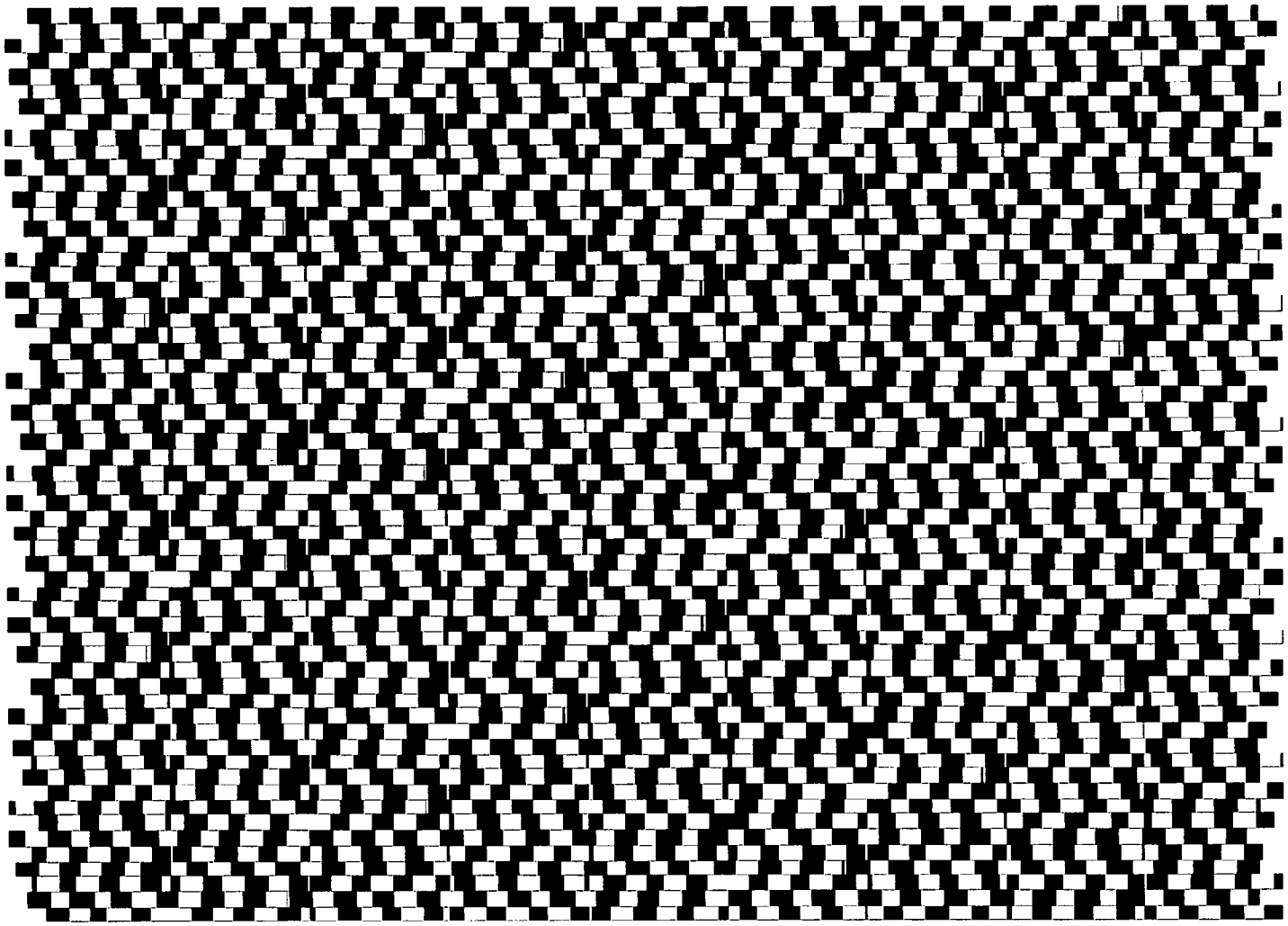
FIG. 9 (PRIOR ART)
FIG. 9 shows the result of a simulation of applying conventional laminated shingles to a 27-foot by 30-foot section of roof using the same rack method of application used in the simulation shown in FIG. 8.

A simulation of the same method over the same area using 36-inch HERITAGES shingles is shown in FIG. 9. The tabs of these shingles ranged in width from 4 inches to 5.5 inches, and included tabs with widths of 4, 4.5, 4.75, 5, 5.125, 5.25, and 5.5 inches. The objectionable patterns most prominent in FIG. 13 are zippering patterns.

Figure 10:
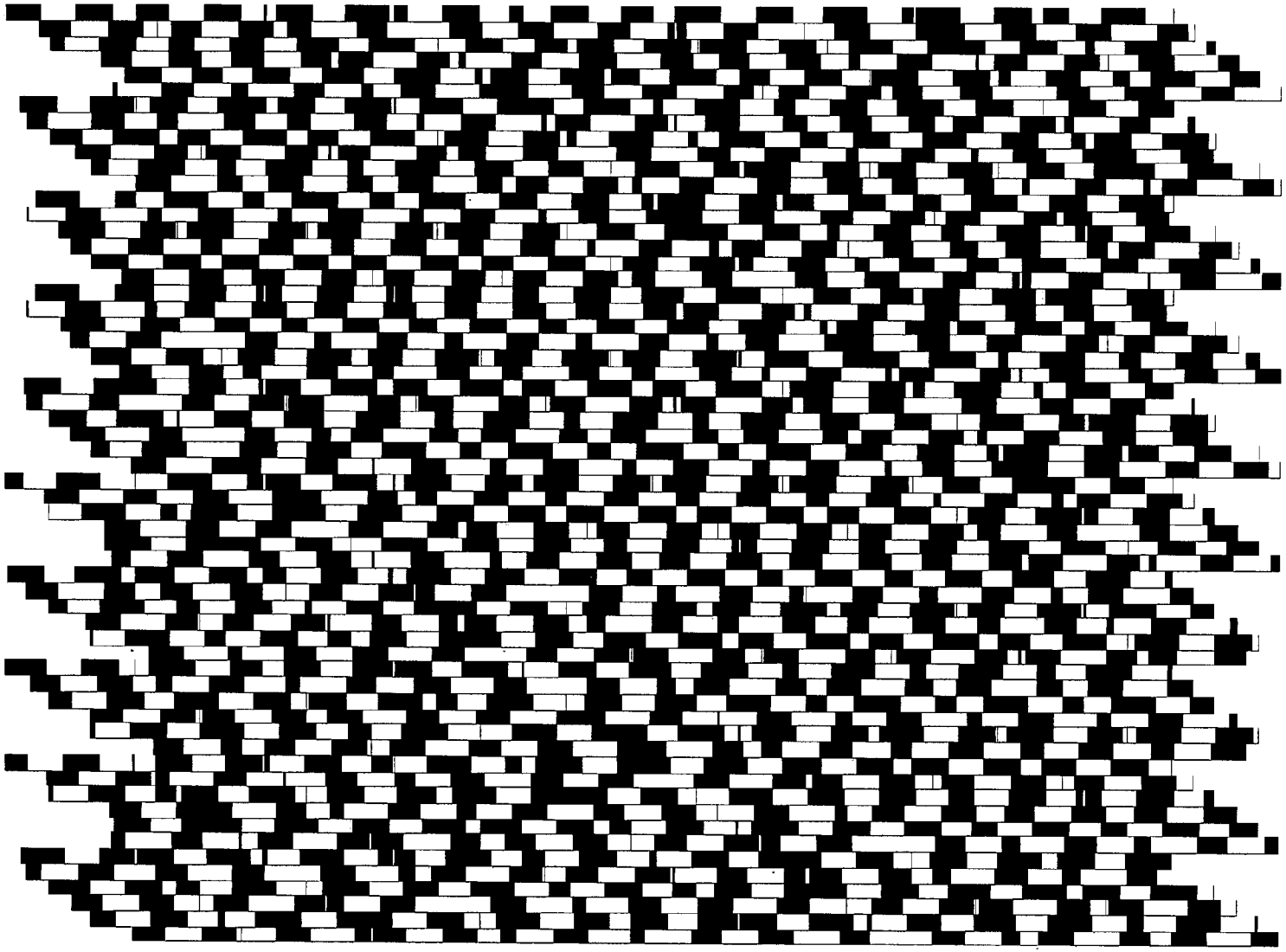
FIG. 10 shows the result of a simulation of applying one embodiment of the present shingles to a 25-foot by 30-foot section of roof using a "6-inch" method of application.

FIG. 10 is a simulation showing the results of applying the present shingles to a 27-foot deep by 30-foot wide section of roof using the "6-inch" method of application.

The "6-inch" method generally involves beginning at a lower corner of a roof, and applying a first course of shingles along the front edge of the roof. When the first course is complete, the first shingle of the next course (which overlaps the first course) should be offset 6 inches from the first shingle of the first course. When the second course is complete, the third course of shingles should be offset 6 inches from the second course. When the third course is complete, the fourth course should be offset 6 inches from the third course. Like the first course, the fifth course should begin at the edge of the roof, and the offsetting repeated for three additional courses, and so on.

The 6-inch method used to generate the simulation shown in FIG. 10 involved shingles that were 36 inches wide and cut by the pattern for 36-inch shingles provided in Table 1. The 6-inch method involved applying shingles in one course across the 30-foot width of the roof, offsetting each of the next three overlapping courses by 6 inches, and beginning this process again with the fifth course.

Figure 11:
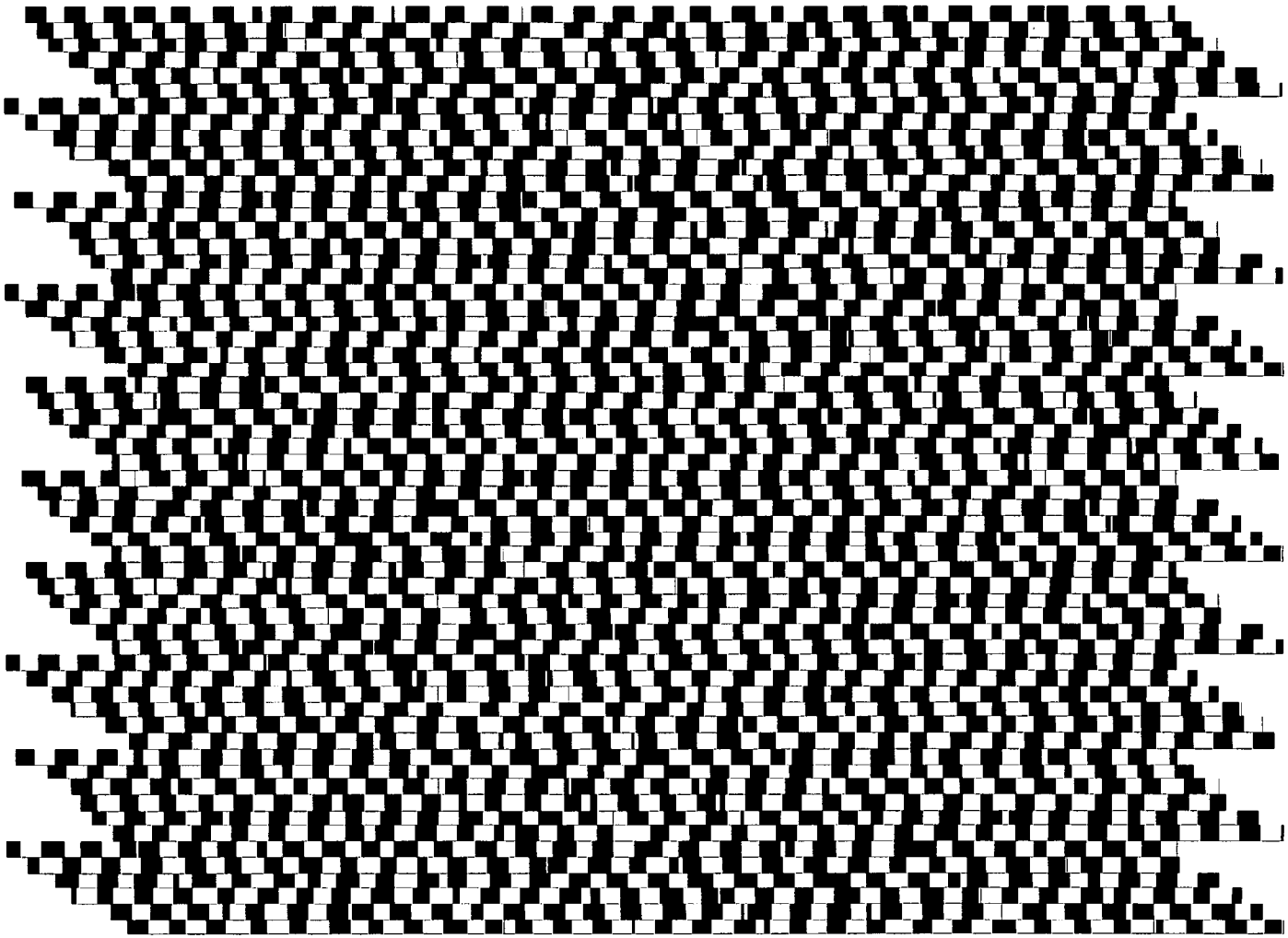
FIG. 11 (PRIOR ART)
FIG. 11 shows the result of a simulation of applying conventional laminated shingles to a 27-foot by 30-foot section of roof using the same 6-inch method of application used in the simulation shown in FIG. 10.

The same shingles used in the simulation shown in FIG. 9 were used to produce the simulation shown in FIG. 11. In the simulation shown in FIG. 11, the same method used to produce the simulation in FIG. 10 was used over the same area.

Figure 12:
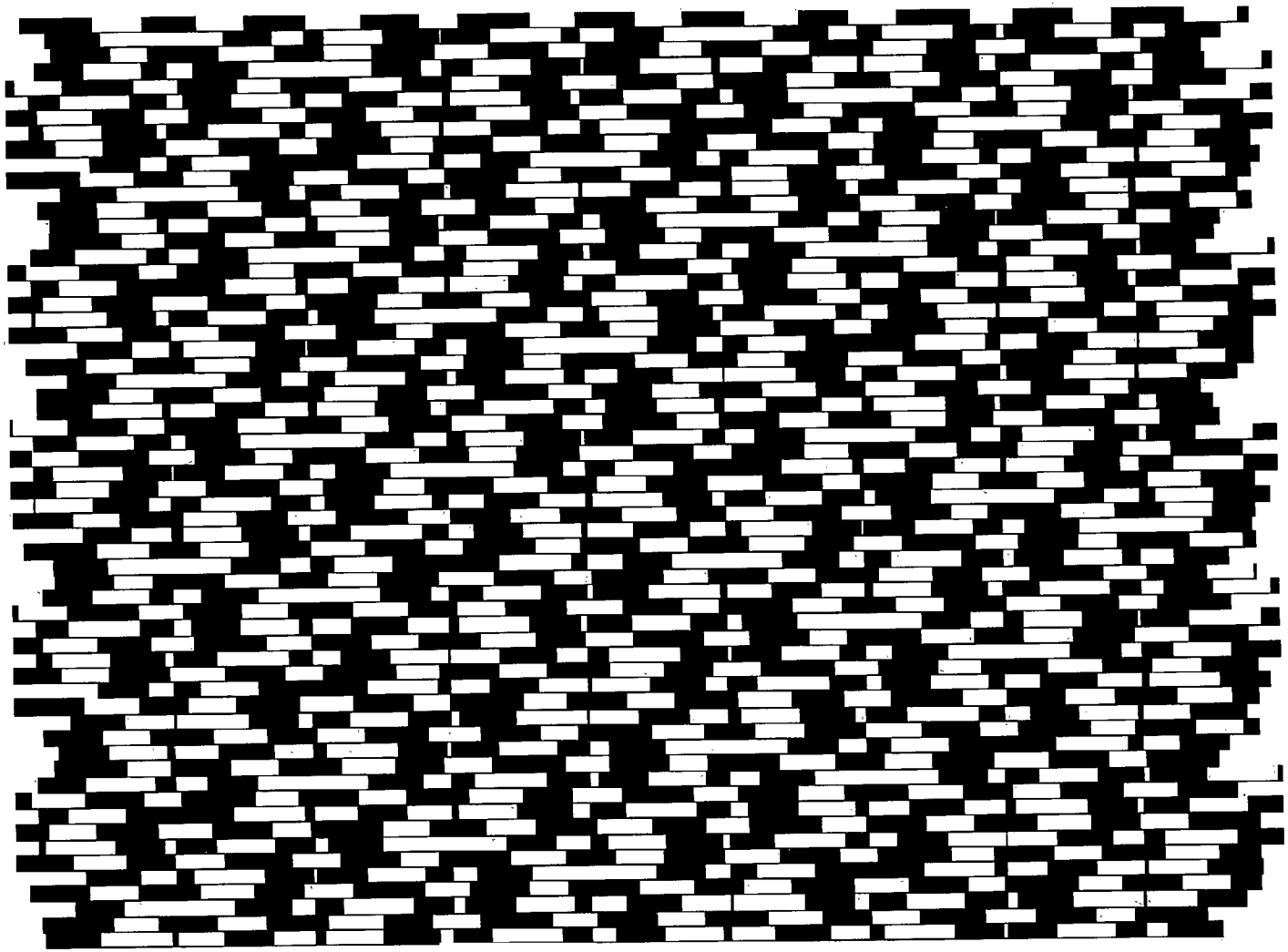
FIG. 12 shows the result of a simulation of applying one embodiment of the present shingles to a 25-foot by 30-foot section of roof using a rack method of application.

FIG. 12 is a simulation showing the results of applying the present shingles to a 25-foot deep by 30-foot wide section of roof using the same rack method of application used to produce the simulation shown in FIG. 10. The shingles used in the simulation shown in FIG. 12 were 36 inches wide and were cut by a modified version of the knife pattern in FIG. 6. Specifically, dimensions A, B, C, D, E, F, K, L, M, N, and O provided in Table 1 for the 36-inch shingle were multiplied by 1.5. The values for dimensions P, Q, R, S, and T from Table 1 remained the same. The dimensions for G, H, I, and J from Table 1 were eliminated, making the shapes of the full tabs, full cut-outs, partial tabs and partial cut-outs rectangular rather than trapezoidal.

The configurations of the present shingles need not be made exactly as described above to fall within the scope of the claims and their equivalents, so long as the full tab/cut-out width to shingle length ratios are met. For example, the lengths of the shingles may fall below the standard U.S. length of 36 inches, or may be above the length of a metric shingle. Similarly, additional layers may be used with the present shingles, making them 3-layered shingles. The thicknesses of the shingle layers may range up or down from a standard thickness of about 3/16 inches. Additionally, methods other than those above may be used to apply the present shingles, such as a 4-inch method (e.g., same as 6-inch method but with 4-inch offsets).

The claims are not to be interpreted as including means-plus- or step-plus-function limitations, unless such a limitation is explicitly recited in a given claim using the phrase(s) "means for" or "step for," respectively.

We claim:

1. A shingle comprising:

a first layer including:

a full tab having a full tab length;

a full cut-out having a full cut-out length;

a full tab width to first layer length ratio greater than 9/36 along the entire length of the full tab;

a full cut-out width to first layer length ratio greater than 8.5/36 along the length of the full cut-out; and a second layer positioned under the first layer.

2. The shingle of claim 1, where the full tab has a butt portion and a top portion, and the butt portion is wider than the top portion.

3. The shingle of claim 1, where the full tab has a butt portion and a top portion, and the top portion is wider than the butt portion.

4. The shingle of claim 1, where the full cut-out has a butt portion and a top portion, and the butt portion is narrower than the top portion.

5. The shingle of claim 1, where the full cut-out has a butt portion and a top portion, and the butt portion is wider than the top portion.

6. The shingle of claim 1, where the full tab width to first layer length ratio is greater than 14/36.

7. The shingle of claim 1, where the full cut-out width to first layer length ratio is greater than 14/36.

8. The shingle of claim 1, the first layer further including:

a second full cut-out; and a second full cut-out width to first layer length ratio greater than 8.5/36.

9. The shingle of claim 1, the first layer further including:

a second full tab; and a second full tab width to first layer length ratio greater than 8.5/36.

10. A method comprising:

applying to a roof shingles having:

a first layer including:

a full tab having a full tab length;

a full cut-out having a full cut-out length;

a full tab width to first layer length ratio greater than 8.5/36 along the entire length of the full tab;

a full cut-out width to first layer length ratio greater than 8.5/36 along the length of the full cut-out; and a second layer positioned under the first layer.

11. The method of claim 10, further comprising:

offsetting the shingles in courses.

12. The method of claim 10, where the full tab of at least one shingle has a butt portion and a top portion, and the butt portion is wider than the top portion.

13. The method of claim 10, where the full tab of at least one shingle has a butt portion and a top portion, and the top portion is wider than the butt portion.

14. The method of claim 10, where the full cut-out of at least one shingle has a butt portion and a top portion, and the butt portion is narrower than the top portion.

15. The method of claim 10, where the full cut-out of at least one shingle has a butt portion and a top portion, and the butt portion is wider than the top portion.

16. The shingle of claim 10, where the full tab width to first layer length ratio is greater than 14/36.

17. The shingle of claim 10, where the full cut-out width to first layer length ratio is greater than 14/36.

* * * * *

UNITED STATES PATENT AND TRADEMARK OFFICE

CERTIFICATE OF CORRECTION

PATENT NO. : 8,438,812 B2
APPLICATION NO. : 10/308731
DATED : May 14, 2013
INVENTOR(S) : Thomas Morrison King et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1826 days.

Signed and Sealed this
Sixteenth Day of December, 2014

Michelle K. Lee

Michelle K. Lee
*Deputy Director of the United States Patent and Trademark Office*